US008388473B2

(12) United States Patent
Smith

(10) Patent No.: US 8,388,473 B2
(45) Date of Patent: Mar. 5, 2013

(54) ARROW SHAFT WITH TRANSITION PORTION

(75) Inventor: Jacob C. Smith, Salt Lake City, UT (US)

(73) Assignee: Easton Technical Products, Inc., Salt Lake City, UT (US)

( * ) Notice: Subject to any disclaimer, the term of this patent is extended or adjusted under 35 U.S.C. 154(b) by 878 days.

(21) Appl. No.: 12/123,896

(22) Filed: May 20, 2008

(65) Prior Publication Data

US 2009/0291785 A1 Nov. 26, 2009

(51) Int. Cl.
*F42B 6/04* (2006.01)

(52) U.S. Cl. ..... 473/578

(58) Field of Classification Search ..... 473/578; 138/177, DIG. 11

See application file for complete search history.

(56) References Cited

U.S. PATENT DOCUMENTS 1,765,709 A * 6/1930 Withington ..... 228/150
2,288,562 A * 6/1942 Birkhofer et al. ..... 473/586
4,533,146 A 8/1985 Schaar
5,074,555 A * 12/1991 Meredith ..... 473/323
5,183,259 A 2/1993 Lyon
5,375,850 A 12/1994 Pickett
6,017,284 A 1/2000 Giles
6,530,865 B2 * 3/2003 Held ..... 482/20
6,821,219 B2 * 11/2004 Thurber ..... 473/578
6,883,552 B2 * 4/2005 Ooyauchi et al. ..... 138/177
6,932,728 B2 * 8/2005 Palomaki et al. ..... 473/578

* cited by examiner

*Primary Examiner* — John Ricci
(74) *Attorney, Agent, or Firm* — Holland & Hart

(57) ABSTRACT

An arrow shaft comprising a first shaft portion and a second shaft portion is disclosed. The second shaft portion of the arrow shaft may have a larger outer diameter than the first shaft portion. The arrow shaft may also comprise a transition portion between the first shaft portion and the second shaft portion. An arrow comprising an arrow shaft, a first shaft portion, a second shaft portion, a nock, and a point is also disclosed. The first shaft portion of the arrow may comprise a lengthwise segment of the arrow shaft terminating at an end of the arrow shaft adjacent to the arrow nock. The second shaft portion of the arrow may comprise a lengthwise segment of the arrow shaft terminating at an end of the arrow shaft adjacent to the arrow point.

40 Claims, 8 Drawing Sheets

ARROW SHAFT WITH TRANSITION PORTION

FIELD OF THE INVENTION

The instant disclosure relates generally to the field of archery arrow systems, including, hunting and target arrow systems.

BACKGROUND

Archery arrows are used in various types of archery, including, for example, hunting and target archery. Target archery includes a variety of disciplines incorporating various equipment, target types, shooting distances, and governing rules.

For example, one type of target archery called "3D" involves the use of a variety of foam targets placed at different locations throughout a specified shooting range. In 3D target archery, the foam targets may be designed in the shape of a particular animal. Distances to the targets in 3D target archery may vary greatly, requiring a high level of skill in distance judgment and aiming. Another type of target archery involves the use of an indoor shooting range in which flat targets are positioned at a relatively short distance of 18 meters from an archer. One of the best known types of target archery is known as "Olympic style." In Olympic-style target archery, archers use recurve bows to shoot arrows at traditional round targets placed at a distance of 70 meters from the archers.

Various types of target archery often involve the use of a target having a pattern of concentric circles on the target surface. The area between a larger concentric circle and the next smaller concentric circle defined within the larger concentric circle is known as a "point zone." The point zones defined by the concentric circles typically increase in point value as the concentric circles decrease in diameter. For example, a point zone defined by a larger concentric circle on a target surface may have a point value of 9, while a point zone defined by the next smaller concentric circle within the larger concentric circle may have a point value of 10. The circles are typically defined by visible lines on the target surface. A common rule in various target archery disciplines is that if an arrow launched by an archer into a target lands at a position in the target that is mostly in a first point zone, but the arrow is touching a line bordering a second point zone having a higher point value, then the higher point value is awarded to the archer.

Archery disciplines may also involve either outdoor or indoor shooting ranges. At outdoor ranges, winds may be present that affect the trajectory of an arrow after it is shot by an archer. For example, cross winds may move an arrow away from an intended course.

SUMMARY

According to at least one embodiment, an apparatus may comprise an arrow shaft having a nock end and a point end. The arrow shaft may comprise a first shaft portion comprising a lengthwise segment of the arrow shaft terminating at the nock end of the arrow shaft, the first shaft portion having an outer diameter. The arrow shaft may also comprise a second shaft portion comprising a lengthwise segment of the arrow shaft, the second shaft portion having an outer diameter. The outer diameter of the second shaft portion may be larger than the outer diameter of the first shaft portion.

In an additional embodiment, the arrow shaft may comprise a first transition portion located between the first shaft portion and the second shaft portion. The first transition portion may comprise a first transition end adjacent to the first shaft portion. The first transition portion may also comprise a second transition end adjacent to the second shaft portion. An outer diameter of the second transition end may be larger than an outer diameter of the first transition end.

In certain embodiments, the first shaft portion may be integrally formed with the second shaft portion. In additional embodiments, the first transition portion may be integrally formed with at least one of the first shaft portion and the second shaft portion. In at least one embodiment, the second shaft portion may comprise a lengthwise segment of the arrow shaft terminating at the point end of the arrow shaft. The second shaft portion may also be located between the point end of the arrow shaft and the first shaft portion.

In another embodiment, the arrow shaft may comprise a third shaft portion comprising a lengthwise segment of the arrow shaft located between the point end of the arrow shaft and the second shaft portion, the third shaft portion having an outer diameter. The outer diameter of the third shaft portion may be smaller than the outer diameter of the second shaft portion. In additional embodiments, the outer diameter of the third shaft portion may be larger than the outer diameter of the second shaft portion.

In certain embodiments, the first transition portion may comprise a first coupling portion structured to extend into a cavity defined in the first shaft portion. The first transition portion may further comprise a second coupling portion extending into a cavity defined in the second shaft portion. In various embodiments, the outer diameter of the first shaft portion may be substantially constant along the length of the first shaft portion. The outer diameter of the second shaft portion may also be substantially constant along the length of the second shaft portion. Additionally, an outer surface of the first transition portion may be tapered between the second transition end and the first transition end. In additional embodiments, the second shaft portion may comprise approximately 50% or less of the axial length of the arrow shaft.

In at least one embodiment, an arrow may comprise an arrow shaft comprising a nock end and a point end. The arrow shaft may also comprise a first shaft portion comprising a lengthwise segment of the arrow shaft terminating at the nock end of the arrow shaft, the first shaft portion having an outer diameter. The arrow shaft may additionally comprise a second shaft portion comprising a lengthwise segment of the arrow shaft, the second shaft portion having an outer diameter. The arrow may also comprise a nock attached at the nock end of the arrow shaft and a point attached at the point end of the arrow shaft. The outer diameter of the second shaft portion may also be larger than the outer diameter of the first shaft portion.

In various embodiments, the arrow may further comprise a first transition portion located between the first shaft portion and the second shaft portion. The first transition portion may comprise a first transition end adjacent to the first shaft portion. The first transition portion may also comprise a second transition end adjacent to the second shaft portion. An outer diameter of the second transition may be larger than an outer diameter of the first transition end.

In certain embodiments, the first shaft portion of the arrow may be integrally formed with the second shaft portion. In additional embodiments, the first transition portion may be integrally formed with at least one of the first shaft portion and the second shaft portion. In at least one embodiment, the second shaft portion may comprise a lengthwise segment of the arrow shaft terminating at the point end of the arrow shaft.

The second shaft portion may also be located between the point end of the arrow shaft and the first shaft portion.

In another embodiment, the arrow shaft of the arrow may comprise a third shaft portion comprising a lengthwise segment of the arrow shaft located between the point end of the arrow shaft and the second shaft portion, the third shaft portion having an outer diameter. The outer diameter of the third shaft portion may be smaller than the outer diameter of the second shaft portion. In additional embodiments, the outer diameter of the third shaft portion may be larger than the outer diameter of the second shaft portion.

In certain embodiments, the first transition portion of the arrow may comprise a first coupling portion structured to extend into a cavity defined in the first shaft portion. The first transition portion may further comprise a second coupling portion extending into a cavity defined in the second shaft portion. In additional embodiments, the second shaft portion may comprise approximately 50% or less of the axial length of the arrow shaft.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

DETAILED DESCRIPTION OF EXEMPLARY EMBODIMENTS

Figure 1:
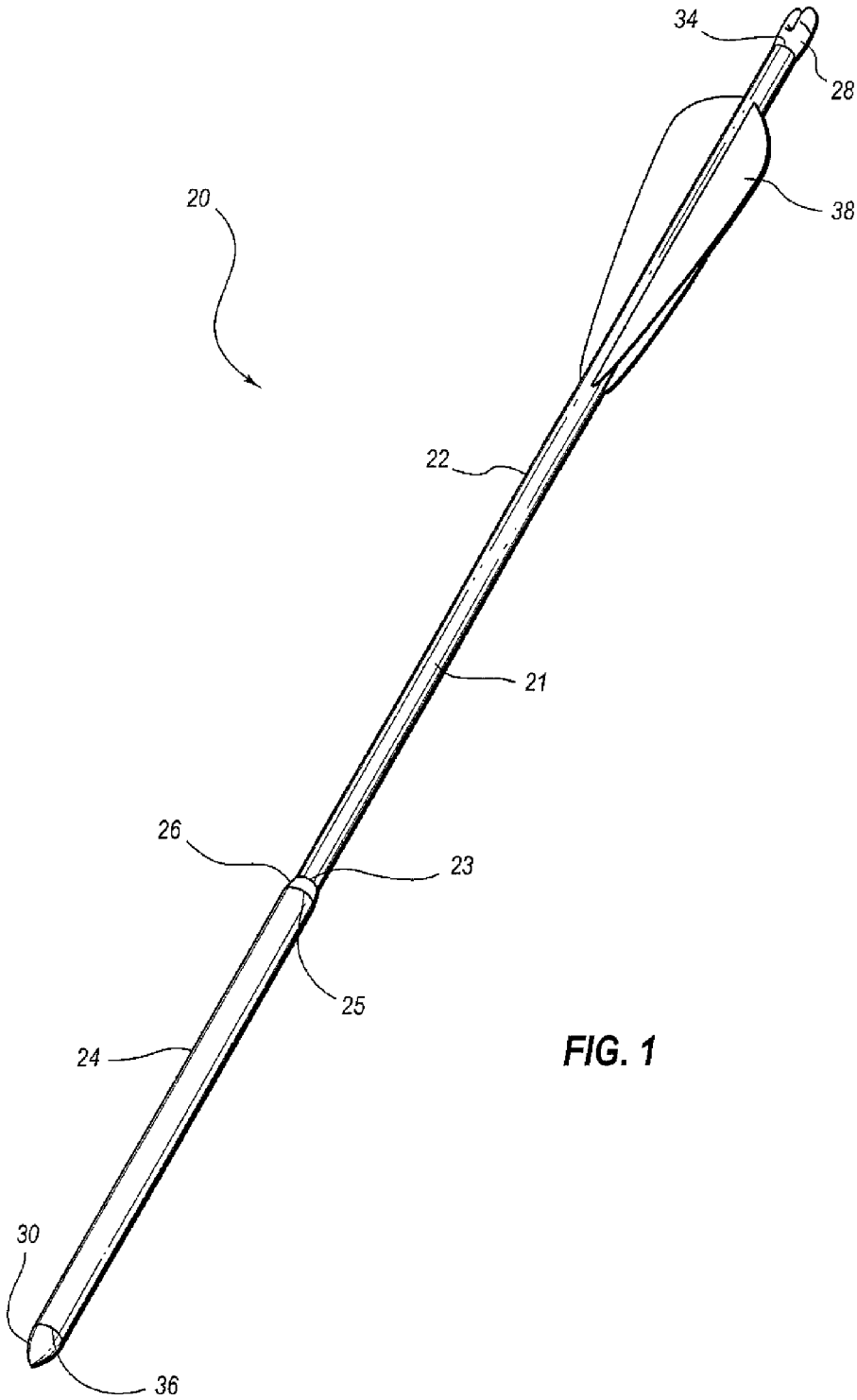
FIG. 1 is a perspective view of an exemplary arrow according to at least one embodiment.

Throughout the drawings, identical reference characters and descriptions indicate similar, but not necessarily identical, elements. While embodiments of the instant disclosure are susceptible to various modifications and alternative forms, specific embodiments have been shown by way of example in the drawings and will be described in detail herein. However, one of skill in the art will understand that embodiments of the instant disclosure are not intended to be limited to the particular forms disclosed herein. Rather, the instant disclosure covers all modifications, equivalents, and alternatives falling within the scope of embodiments defined by the appended claims.

FIG. 1 is an illustration of an exemplary arrow 20 according to at least one embodiment. As illustrated in this figure, arrow 20 may comprise a nock 28, an arrow point 30, fletching 38 in the form of one or more vanes or feathers, and an arrow shaft 21. Arrow shaft 21 may also comprise a nock end 34, a point end 36, a first shaft portion 22, a second shaft portion 24, and a transition portion 26. As shown in FIG. 1, the transition portion 26 in positioned between the fletching 38 and arrow point 30. FIG. 1 also shows the transition portion 26 positioned between the fletching 38 and the second shaft portion 24.

Arrow shaft 21 may represent any type or form of shaft suitable for use in archery applications. Examples of arrow shaft 21 may include, without limitation, hollow or solid arrow shafts suitable for use in various archery applications. Arrow shaft 21 may also be formed in any shape or size and of any material or combination of materials, including, for example, wood, aluminum, carbon fiber, or any other suitable material. In one exemplary embodiment, the outer diameter of arrow shaft 21 may vary along its length. For example, as will be discussed in greater detail below, arrow shaft 21 may comprise a first shaft portion 22 and a second shaft portion 24 having an outer diameter that is larger than an outer diameter of first shaft portion 22.

Nock 28 may represent any type or form of apparatus capable of receiving at least a portion of a bowstring. Arrow point 30 may represent any type or form of point capable of penetrating a desired target in an archery application. Examples of point 30 include, without limitation, field points and broadhead points. Fletching 38 may comprise any type of fletching or fin suitable for stabilizing and/or improving the accuracy of arrow 20 while in flight, including without limitation vanes or feathers.

Nock 28, arrow point 30, and fletching 38 may each be attached to arrow shaft 21 in a number of ways. For example, nock 28 and/or arrow point 30 may comprise a protruding portion structured to fit into a hollow end portion of arrow shaft 21. In at least one embodiment, nock 28 and/or arrow point 30 may be coupled to arrow shaft 21, being held in place by, for example, frictional and/or mechanical resistance between a protruding portion of nock 28 or arrow point 30 and an interior wall of arrow shaft 21. In an additional embodiment, nock 28, arrow point 30, and/or vane 38 may be securely affixed to arrow shaft 21 using, for example, an adhesive material. Nock 28 and/or arrow point 30 may also be threadedly coupled to arrow shaft 21

As detailed above, and as illustrated in FIG. 1, arrow shaft 21 may comprise a first shaft portion 22 and a second shaft portion 24. First shaft portion 22 and second shaft portion 24 may each be formed of any material or combination of materials, including, for example, aluminum, carbon fiber, wood, or any other suitable material. First shaft portion 22 and second shaft portion 24 may also each be formed in any shape or size, including, for example, a generally cylindrical or non-cylindrical shape. First shaft portion 22 and/or second shaft portion 24 may also, however, comprise segments that may not be cylindrical in shape. First shaft portion 22 and second shaft portion may comprise a cross-sectional shape that may be non-circular but axially symmetrical.

Figure 2A:
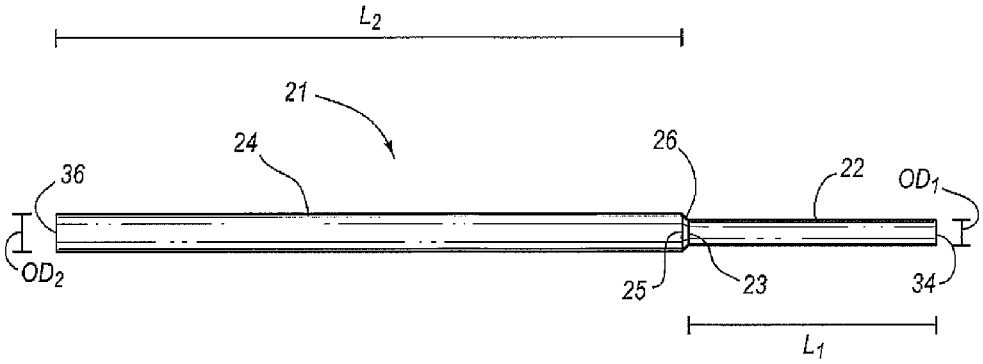
FIG. 2A is a side view of an exemplary arrow shaft according to at least one embodiment.

In certain embodiments, the outer diameter of at least a portion of the second shaft portion 24 may be larger than the outer diameter of at least a portion of the first shaft portion 22. For example, as illustrated in FIG. 2A, in one embodiment, arrow shaft 21 may comprise a second shaft portion 24 having an outside diameter $OD_2$ that is larger than an outside diameter $OD_1$ of a first shaft portion 22. As will be discussed in detail below, first shaft portion 22, second shaft portion 24, and/or transition portion 26 may be integrally formed or formed of discrete elements. As seen in FIG. 1, at least one fletch 38 may be attached to first portion 22.

As illustrated in FIG. 1, nock end 34 of arrow shaft 21 may be located at one end of arrow shaft 21 adjacent to nock 28. Point end 36 may be located at an end of arrow shaft 21 opposite nock end 34 and adjacent to arrow point 30. In at least one embodiment, first shaft portion 22 may comprise a lengthwise segment of arrow shaft 21 comprising and/or terminating at nock end 34. Second shaft portion 24 may comprise a lengthwise segment of arrow shaft 21 distinct from first shaft portion 22. For example, second shaft portion 24 may comprise a lengthwise segment of arrow shaft 21 comprising and/or terminating at point end 36.

As seen in FIG. 1, transition portion 26 may comprise a segment of arrow shaft 21 located between first shaft portion 22 and second shaft portion 24. Transition portion 26 may be formed of any material or combination of materials, including, for example, aluminum, carbon fiber, various polymeric materials, various metallic materials, or any other suitable material. Additionally, transition portion 26 may be formed in any shape or size, without limitation. For example, transition portion 26 may be formed in a substantially conical shape, a cylindrical shape, or a generally tapered shape. Further, transition portion 26 may comprise any cross-sectional shape and may extend lengthwise along the arrow for any length. In at least one embodiment, transition portion 26 may comprise a first transition end 23 positioned adjacent to first shaft portion 22 and a second transition end 25 positioned adjacent to second shaft portion 24. In at least one embodiment, first transition end 23 may have a diameter that is smaller than a diameter of second transition end 25. For example, the outer diameter of transition portion 26 may taper from the relatively larger outer diameter of second transition end 25 to the relatively smaller outer diameter of first transition end 23. As will be discussed below, the slope of transition portion 26 may taper gradually or abruptly.

As illustrated in FIG. 1, nock 28 may be axially adjacent to first shaft portion 22, first shaft portion 22 may be axially adjacent to transition portion 26, transition portion 26 may be axially adjacent to second shaft portion 24, and/or second shaft portion 24 may be provided at a mid-span location axially adjacent to arrow point 30. The axial position of transition portion 26 and/or the lengths of first shaft portion 22 and second shaft portion 24 may be determined based on a variety of factors, including without limitation the factors that influence arrow penetration 20 into a target. Further, other factors may include, without limitation, the archer's shooting technique, the type of bow used, the type of target used, and any other factors. FIG. 1 shows the transition portion located at a middle position on the arrow shaft. In at least one embodiment, as illustrated in FIG. 2A, the length of second shaft portion 24 may be chosen so that at least a portion of second shaft portion 24 projects from the surface of a target following the shooting of arrow 20 from a bow into the target. In at least one embodiment, the length of second shaft portion 24 may comprise approximately 50% or less of the length of arrow shaft 21.

When used in various archery applications, such as, for example, target archery, arrow 20 may yield various advantages. In at least one embodiment, the relatively larger diameter of second shaft portion 24 may have a much greater likelihood of contacting an intended portion of an archery target than an arrow having a smaller diameter shaft or shaft portion. For example, arrow 20 may have a greater likelihood of contacting a target line portion bordering a point zone that has a higher point value than a conventional arrow.

In various embodiments, the length of second shaft portion 24 may be shortened to decrease the overall weight of arrow 20 and increase the durability of arrow 20. The length of second shaft portion 24 may also be shortened in order to decrease the effects of wind resistance and wind drift on arrow 20. Relatively smaller diameter portions of arrow shaft 21, such as, for example, first shaft portion 22, may lessen the impact of a cross wind on the arrow 20, and thus arrow drift, as compared to an arrow having a shaft with a relatively larger diameter (e.g., a diameter substantially equivalent to the diameter of second shaft portion 24) over a more substantial portion of the shaft than arrow shaft 21. Accordingly, relatively smaller diameter portions of arrow shaft 21, such as, for example, first shaft portion 22, may increase the overall accuracy of arrow 20 in situations where wind or other air currents may be a factor.

In addition, the relatively smaller diameter portions of arrow shaft 21, such as, for example, first shaft portion 22, may increase the overall durability and decrease the overall weight of arrow 20 as compared to an arrow having a shaft with a relatively larger diameter over a more substantial portion of the arrow shaft 21. This combination of higher durability and lower weight may increase the accuracy of arrow 20.

In an additional embodiment, the stiffness of first shaft portion 22 may be different from the stiffness of second shaft portion 24. In at least one embodiment, first shaft portion 22, which may have a relatively smaller diameter than second shaft portion 24, may have a lower stiffness or spine as compared to the second shaft portion 24. The relatively lower stiffness or spine of first shaft portion 22 may provide a variety of benefits, including, for example, improved arrow flight. In addition, arrow 20, comprising first shaft portion 22 having a lower spine than second shaft portion 24, may compensate for imperfections in archer technique and imperfections in the bow from which the arrow is shot. For example, the relatively lower spine of first shaft portion 22 may allow first portion 22 to flex sufficiently to match the particular archery bow, enabling arrow 20 to travel more accurately after being fired from a bow.

Figure 2B:
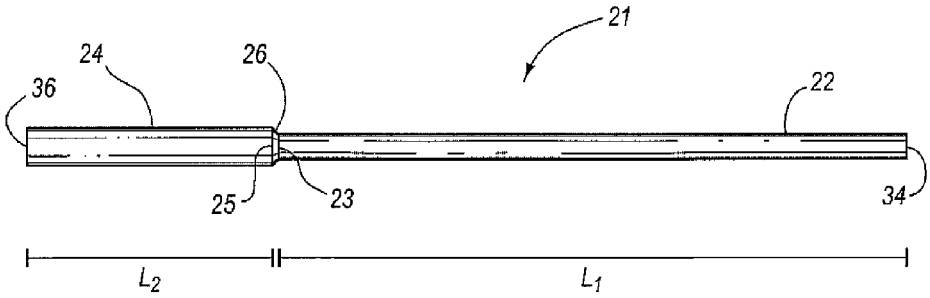
FIG. 2B is a side view of an exemplary arrow shaft according to an additional embodiment.

FIGS. 2A and 2B illustrate various exemplary embodiments of arrow shaft 21. As illustrated in these figures, transition portion 26 may be located at any point along the axial length of arrow shaft 21. Additionally, the lengths of first shaft portion 22 and second shaft portion 24 may differ with respect to the overall length of arrow shaft 21 and the axial position and/or length of transition portion 26, without limitation.

As detailed above, the axial position of transition portion 26 and the lengths of first shaft portion 22 and second shaft portion 24 may be determined based on a variety of factors, such as factors influencing the depth that arrow 20 may penetrate into a target, including, for example and without limitation, the technique of an archer shooting the arrow, the type of bow used, the type of target used, and any other parameter affecting the penetration of arrow 20 into a target. In at least one embodiment, as illustrated in FIG. 2A, the length of second shaft portion 24 may be sufficiently long so that at least a portion of second shaft portion 24 projects from the surface of a target following the shooting of arrow 20 from a bow into the target. In this embodiment, the length $L_2$ of second shaft portion 24 may be greater then the length $L_1$ of first shaft portion 22.

In another embodiment, as illustrated in FIG. 2B, the length of second shaft portion 24 may be shortened to decrease the overall weight of arrow 20 and also change the spine of arrow 20. In this embodiment, the length $L_2$ of second shaft portion 24 may be less than the length $L_1$ of first portion 22. The length of second shaft portion 24 may also be shortened in order to enhance the aerodynamic efficiency and decrease the effects of wind drift on arrow 20. In this embodiment the length $L_2$ of second shaft portion 24 may be less than the length $L_1$ of first shaft portion 22. In an additional embodiment, the length of second shaft portion 24 may comprise approximately 50% or less of the length of arrow shaft 21.

Figure 3A:
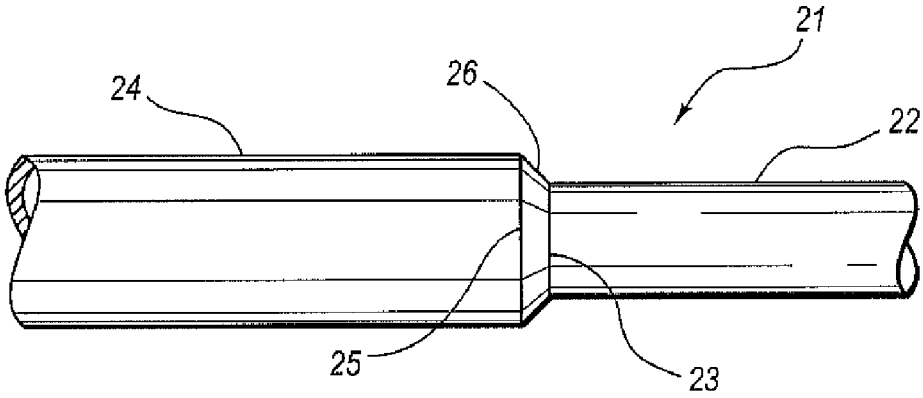
FIG. 3A is a side view of a portion of an exemplary arrow shaft according to an additional embodiment.
Figure 3B:
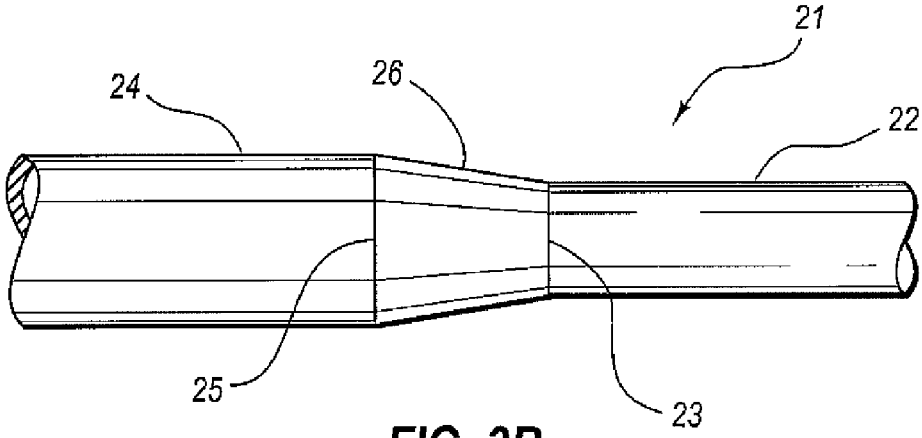
FIG. 3B is a side view of a portion of an exemplary arrow shaft according to an additional embodiment.
Figure 3C:
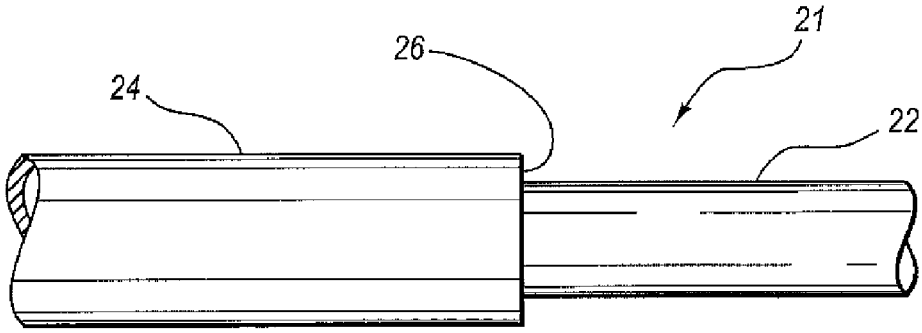
FIG. 3C is a side view of a portion of an exemplary arrow shaft according to an additional embodiment.

FIGS. 3A-3C illustrate various exemplary embodiments of arrow shaft 21. As illustrated in FIGS. 3A-3C, transition portion 26 may be formed to any length and in any shape, without limitation. Additionally, the lengths of first shaft portion 22 and second shaft portion 24 may differ with respect to the overall length of arrow shaft 21, their respective axial positions, and the length of transition portion 26 between portion 22 and portion 24, without limitation.

In at least one embodiment, as illustrated in FIG. 3A, transition portion 26 may have a relatively shorter length, resulting in a relatively steeper transition between first transition end 23 and second transition end 25 along the axial length of arrow shaft 21. In another embodiment, as illustrated in FIG. 3B, transition portion 26 may have a relatively longer length, resulting in a more gradual transition between first transition end 23 and second transition end 25 along the axial length of arrow shaft 21, as compared to the steep transition shown in FIG. 3A. In addition, as illustrated in FIG. 3C, the slope of transition portion 26 between a second shaft portion 24 and first portion 22 may be substantially perpendicular to the surface of arrow shaft 21.

Figure 4A:
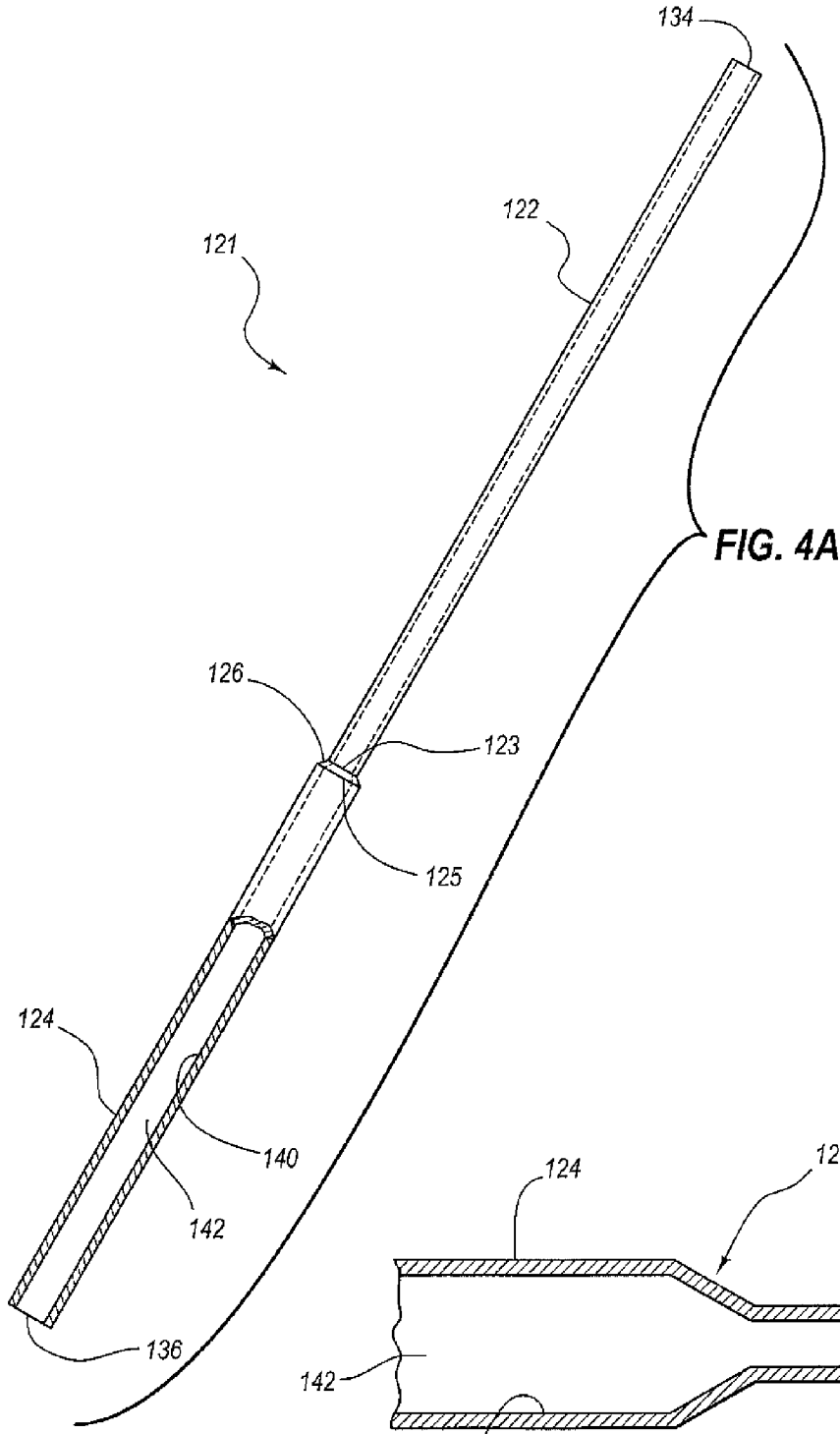
FIG. 4A is a partial-sectional side view of an exemplary arrow shaft according to an additional embodiment.
Figure 4B:
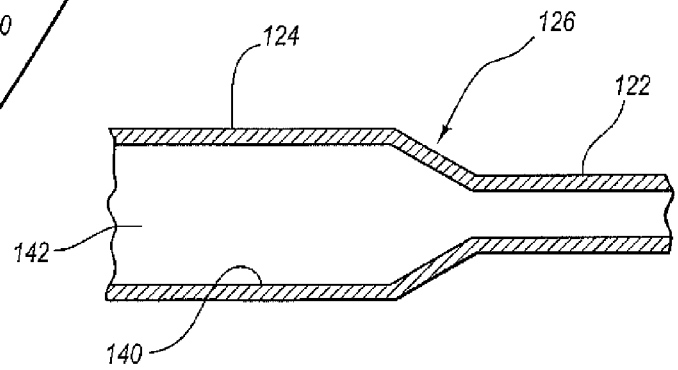
FIG. 4B is a sectional side view of a portion of an exemplary arrow shaft according to an additional embodiment.

FIGS. 4A and 4B illustrate an exemplary arrow shaft 121 according to an additional embodiment. As illustrated in these figures, arrow shaft 121 may comprise a nock end 134, a point end 136, a first shaft portion 122, a second shaft portion 124, and a transition portion 126. Additionally, transition portion 126 may comprise a first transition end 123 and a second transition end 125. Further, arrow shaft 121 may comprise a hollow portion or cavity 142 defined by an interior surface 140.

By including cavity 142 in arrow shaft 121, the overall weight of arrow shaft 121 may be either decreased or increased, thereby optimizing its overall weight. Additionally, in at least one embodiment, a male connection portion of a nock (e.g., nock 28) may be inserted into at least a portion of cavity 142 adjacent to nock end 134. In an additional embodiment, a connecting portion of an arrow point (e.g., arrow point 30) may be inserted into at least a portion of cavity 142 adjacent to point end 136.

As seen in FIGS. 4A and 4B, first shaft portion 122, second shaft portion 124, and transition portion 126 may be integrally formed. In at least one embodiment, cavity 142 may be defined by interior surface 140 within each of first shaft portion 122, second shaft portion 124, and transition portion 126.

FIGS. 5A-5E illustrate various embodiments of an exemplary arrow shaft 221. As illustrated in these figures, arrow shaft 221 may comprise a nock end 234, a point end 236, a first shaft portion 222, a second shaft portion 224, and a transition portion 226. Transition portion 226 may comprise a first transition end 223 and a second transition end 225.

Figure 5A:
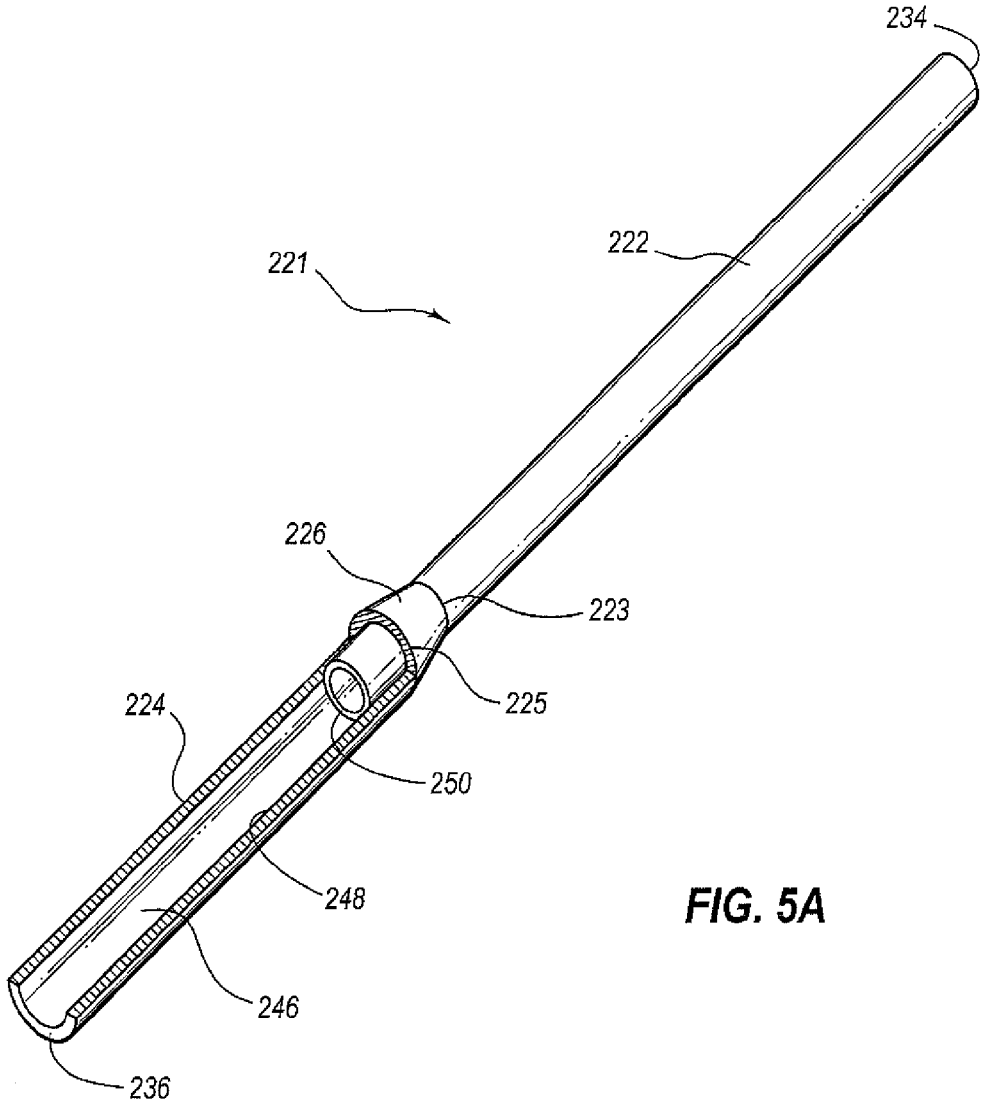
FIG. 5A is a partial-sectional perspective view of an exemplary arrow shaft according to an additional embodiment.
Figure 5B:
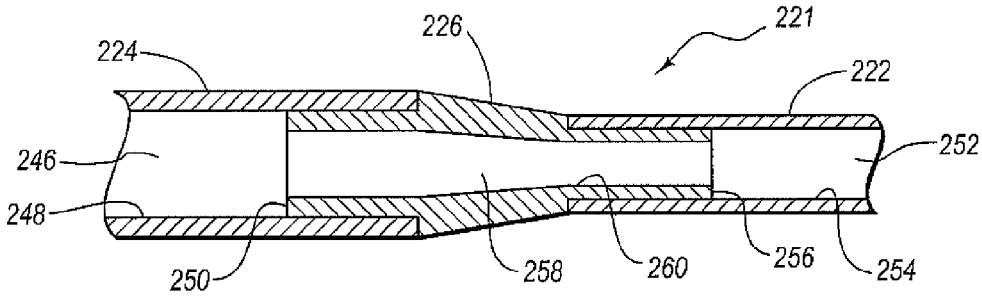
FIG. 5B is a sectional side view of a portion of an exemplary arrow shaft according to an additional embodiment.
Figure 5C:
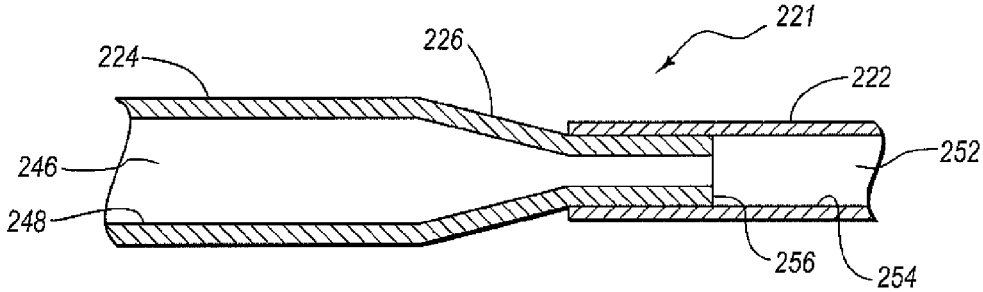
FIG. 5C is a sectional side view of a portion of an exemplary arrow shaft according to an additional embodiment.

In certain embodiments, as illustrated in FIGS. 5B and 5C, first shaft portion 222 may comprise a hollow portion or cavity 252 defined by an interior surface 254. In at least one embodiment, transition portion 226 may comprise a first coupling portion 256 extending into cavity 252 defined in first shaft portion 222. Transition portion 226 may be securely coupled to first shaft portion 222 through, for example, frictional and/or mechanical resistance between first coupling portion 256 and interior surface 254. In an additional embodiment, first coupling portion 256 may be securely affixed to interior surface 254 using any suitable material, including, for example and without limitation, an adhesive material.

As illustrated in FIGS. 5A and 5B, second shaft portion 224 may comprise a hollow portion or cavity 246 defined by an interior surface 248. In at least one embodiment, transition portion 226 may comprise a second coupling portion 250 extending into cavity 246 defined in second shaft portion 222. Transition portion 226 may be securely coupled to second shaft portion 224 through, for example, frictional and/or mechanical resistance between second coupling portion 250 and interior surface 248. In an additional embodiment, second coupling portion 250 may be securely affixed to interior surface 248 using any suitable material, including, for example and without limitation, an adhesive material. Second coupling portion 250 may also be threadedly coupled to interior surface 248.

As illustrated in FIG. 5B, transition portion 226 may be a distinct member coupled to both first shaft portion 222 and second shaft portion 224. Transition portion 226 may represent any type or form of connecting member suitable for connecting a relatively smaller diameter element, such as, for example, first shaft portion 222, to a relatively larger diameter element, such as, for example, second shaft portion 224. Examples of transition portion 226 may include, without limitation, a hollow or solid bushing element. Transition portion 226 may be formed in any shape or size and of any material or combination of materials, including, for example, various metal, carbon, or polymer materials. Transition portion 226 may be formed through any means, including, for example, machining.

Figure 5D:
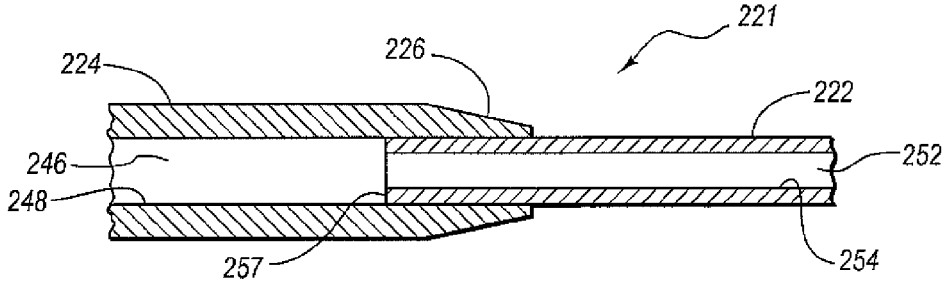
FIG. 5D is a sectional side view of a portion of an exemplary arrow shaft according to an additional embodiment.
Figure 5E:
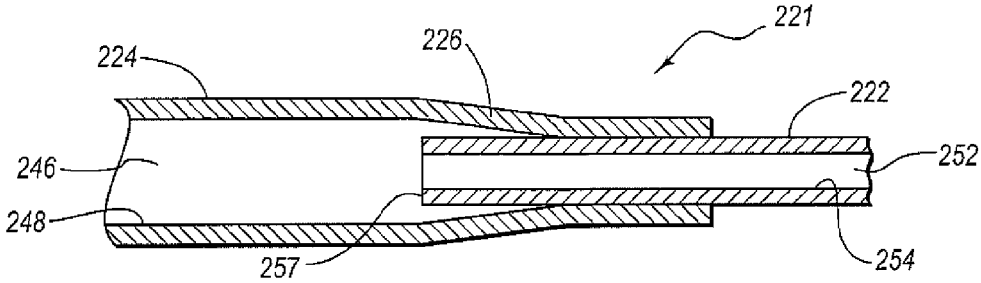
FIG. 5E is a sectional side view of a portion of an exemplary arrow shaft according to an additional embodiment.

In at least one embodiment, as illustrated in FIGS. 5C-5E, transition portion 226 may be integrally formed with first shaft portion 222 and/or second shaft portion 224. For example, as illustrated in FIG. 5C, transition portion 226 and second shaft portion 224 may both be formed from a single tubular element, such as, for example, a tube comprising aluminum, carbon fibers, or any other suitable material or combination of materials. In an additional embodiment, transition portion 226 may be formed by reducing the diameter of an end portion of second shaft portion 224 by any known means, including, for example, by bending or swaging the end portion of second shaft portion 224 with a swage tool.

In additional embodiments, as seen in FIGS. 5D and 5E, transition portion 226 may be formed integrally with second shaft portion 224. An end portion of first shaft portion 222 may comprise a first shaft coupling portion 257 extending into cavity 246 defined in second shaft portion 222 and transition portion 226. Transition portion 226 may be securely coupled to first shaft portion 222 through, for example, frictional and/or mechanical resistance between first shaft coupling portion 257 and interior surface 248. First shaft coupling portion 257 may also be securely affixed to interior surface 248 using any suitable material, including, for example without limitation, an adhesive material. First shaft coupling portion 257 may additionally be threadedly coupled to interior surface 248.

Figure 6A:
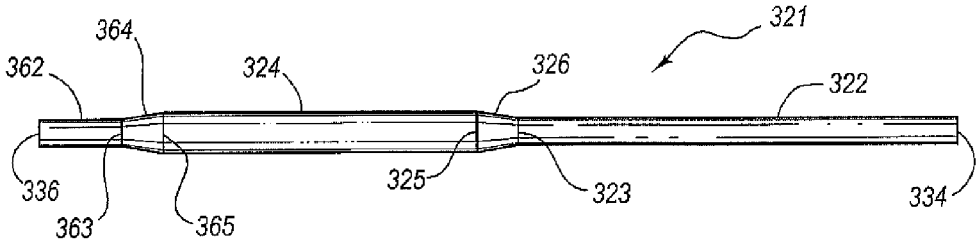
FIG. 6A is a side view of an exemplary arrow shaft according to an additional embodiment.
Figure 6B:
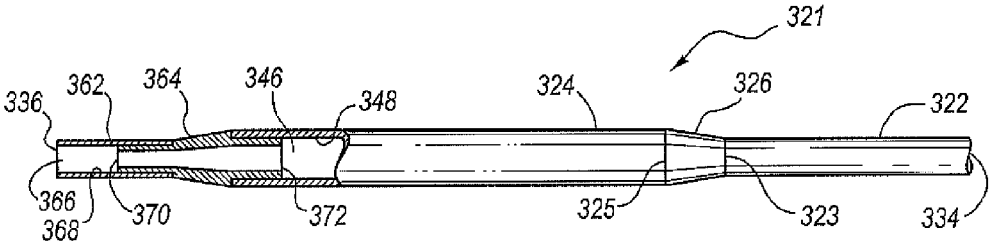
FIG. 6B is a partial-sectional side view of an exemplary arrow shaft according to an additional embodiment.
Figure 6C:
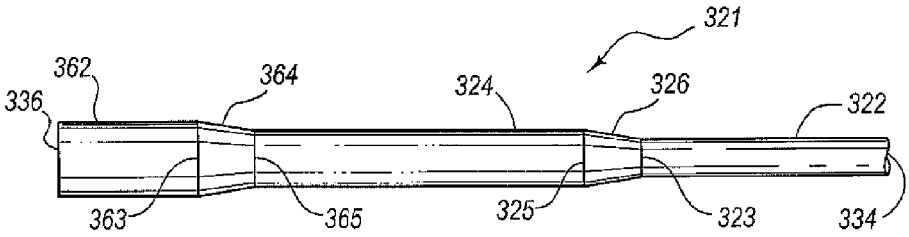
FIG. 6C is a side view of an exemplary arrow shaft according to an additional embodiment.

FIGS. 6A-6C illustrate various embodiments of an exemplary arrow shaft 321. As illustrated in these figures, arrow shaft 321 may comprise a nock end 334, a point end 336, a first shaft portion 322, a second shaft portion 324, and a first transition portion 326. First transition portion 326 may comprise a first transition end 323 and a second transition end 325. Arrow shaft 321 may also comprise a third shaft portion 362 and a second transition portion 364. Second transition portion 364 may comprise a first transition end 363 and a second transition end 365.

Third shaft portion 362 may be formed of any material or combination of materials, and may be formed in any shape or size. In an exemplary embodiment, the outer diameter of third shaft portion 362 may be smaller than the outer diameter of second shaft portion 324. Third shaft portion 362 may also comprise segments that are cylindrical or non-cylindrical in shape. In additional embodiments, third shaft portion 362 may comprise a plurality of lengthwise segments that differ in diameter from one another. Third shaft portion 362 may also comprise a lengthwise segment of arrow shaft 321 comprising point end 336. In additional embodiments, as shown in FIG. 6C, the outer diameter of third shaft portion 362 may be larger than the outer diameter of second shaft portion 324.

Second transition portion 364 may comprise a segment of arrow shaft 321 located between second shaft portion 324 and third shaft portion 362, Second transition portion 364 may be formed of any material or any combination of materials, and may be formed in any shape or size, without limitation. In addition, first transition end 363 of second transition portion 364 may be adjacent to third shaft portion 362, and second transition end 365 of second transition portion 364 may be adjacent to second shaft portion 324. In at least one embodiment, the outer diameter of first transition end 363 may be smaller than the outer diameter of second transition end 365. In certain embodiments, second transition portion 326 may taper, either gradually or abruptly, from second transition end 365 to first transition end 363.

As illustrated in FIGS. 6A-6C, first shaft portion 322 may be axially adjacent to first transition portion 326, first transition portion 326 may be axially adjacent to second shaft portion 324, second shaft portion 324 may be axially adjacent to second transition portion 364, and/or second transition portion 364 may be axially adjacent to third shaft portion 362.

In at least one embodiment, arrow shaft 321 may comprise a hollow portion or cavity defined by an interior surface of arrow shaft 321 (see, e.g., FIG. 4). Second shaft portion 324 and/or third shaft portion 362 may also comprise at least one hollow portion or cavity (see, e.g., FIGS. 5A-5C). Second transition portion 364 may also comprise at least one coupling portion extending into a cavity defined in second shaft portion 324 and/or third shaft portion 362, coupling second transition portion 364 to second shaft portion 324 and/or third shaft portion 362 (see, e.g., FIGS. 5A-5C). As with first transition portion 326, second transition portion 364 may be integrally formed with second shaft portion 324 and/or third shaft portion 362.

In the exemplary embodiment illustrated in FIG. 6B, second transition portion 364 may be formed from a distinct member coupled to both second shaft portion 324 and third shaft portion 362. Second transition portion 364 may represent any type or form of connecting member suitable for connecting a first element, such as, for example, third shaft portion 362, to a second element having a relatively larger diameter, such as, for example, second shaft portion 324. In additional embodiments, second transition portion 364 may represent a connecting member suitable for connecting a first element, such as third shaft portion 362, to a second element having a relatively smaller diameter, such as second shaft portion 324 (see, e.g., FIG. 6C). Examples of second transition portion 364 may include, without limitation, a bushing element (see, e.g., transition portion 226 in FIG. 5B).

Figure 7A:
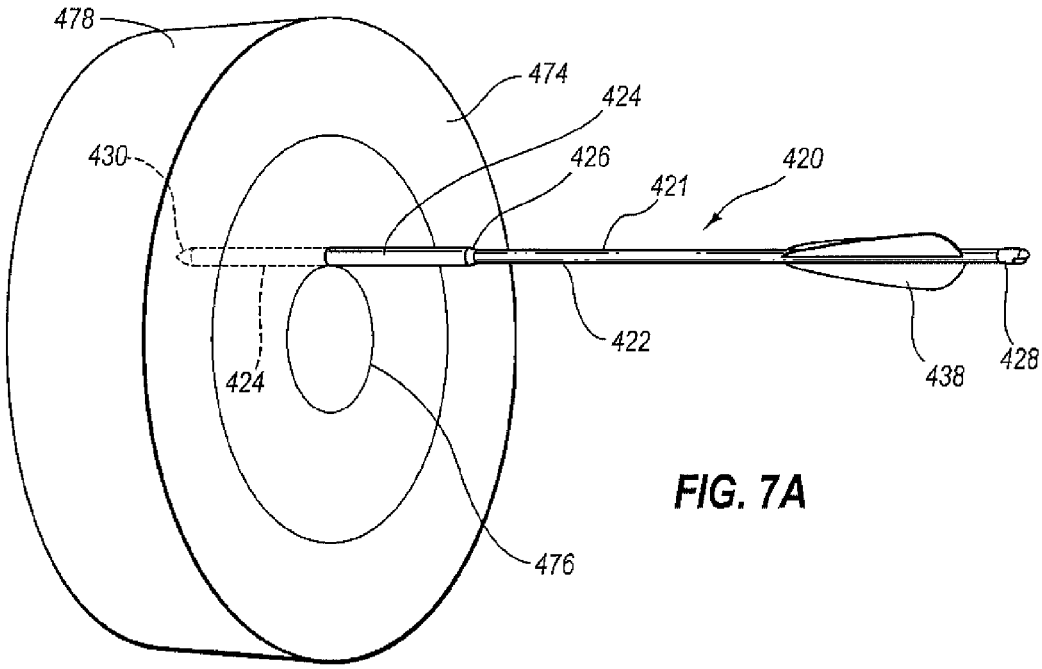
FIG. 7A is a perspective view of an arrow, according to one or more of the exemplary embodiments described and/or illustrated herein, lodged in a representative archery target.
Figure 7B:
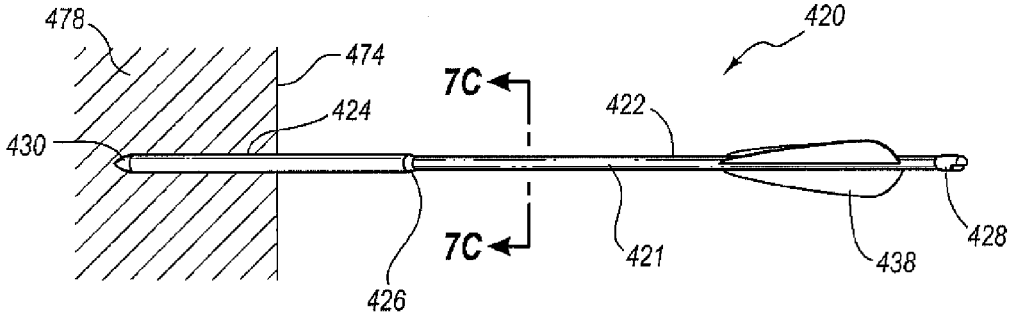
FIG. 7B is a side view of the arrow illustrated in FIG. 7A.
Figure 7C:
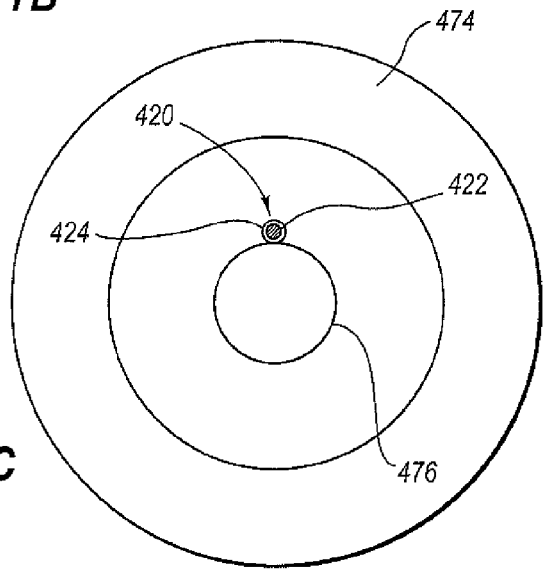
FIG. 7C is a sectional view of the arrow illustrated in FIG. 7B, taken along line 7C-7C.

FIGS. 7A-7C illustrate an exemplary arrow 420 according to an additional embodiment. As illustrated in these figures, arrow 420 may comprise a nock 428, an arrow point 430, at least one vane 438, and an arrow shaft 421. Additionally, arrow shaft 421 may comprise a first shaft portion 422, a second shaft portion 424, and a transition portion 426. FIGS. 7A-7C show arrow 420 lodged into a target 478 subsequent to, for example, being launched from an archery bow. Target 478 generally represents any type or form of archery target. In at least one embodiment, and as illustrated in FIGS. 7A-7B, target 478 may comprise a target surface 474 comprising at least one target ring 476.

As shown in FIGS. 7A-7C, arrow 420 may become lodged in target 478 after being launched from an archery bow. Subsequent to being launched from a bow and prior to becoming lodged in target 478, arrow 420 will encounter resistance, such as frictional resistance, from target 478 as arrow 420 penetrates target 478. As arrow 420 encounters resistance from target 478, it will slow the arrow 420 until it comes to rest at a particular position. As shown in FIGS. 7A and 7B, a portion of arrow shaft 421 may penetrate into target 478. The amount of arrow shaft 421 that may penetrate into target 478 may depend on a variety of factors, including, without limitation, the velocity at which arrow 420 is moving prior to encountering the target 478, the mass of the arrow 420, the diameter of arrow shaft 421, the composition of target 478, and many other factors.

In one exemplary embodiment, second shaft portion 424 of arrow shaft 421 may be larger in diameter than first shaft portion 422. As illustrated in FIGS. 7A and 7B, after being launched from a bow, second shaft portion 424 of arrow shaft 421 may penetrate and become lodged in target 478, while transition portion 426 and first shaft portion 422 may remain outside of target 478. As illustrated in FIG. 7C, the first shaft portion 422 and second shaft portion 424 each have a continuous, smooth outer circumference with an outer surface that is unbroken.

When used in various types of archery, such as, for example, target archery, arrow 420 may yield significant advantages. For example, as shown in FIG. 7C, the portion of arrow 420 touching target surface 474 of target 478 may be second shaft portion 424, which may have a relatively larger diameter than the remainder of arrow shaft 421. A larger diameter shaft segment, such as second shaft portion 424, may occupy a relatively greater surface area of target surface 474 than a smaller diameter shaft segment. In a situation where the axis of arrow 420 is positioned in close proximity to target ring 476, a larger diameter shaft portion, such as second shaft portion 424, may have a much greater likelihood of contacting target ring 476 (and thus achieving the higher score) than a smaller diameter shaft or shaft portion.

Additionally, the relatively smaller diameter portions of arrow shaft 421, such as, for example, first shaft portion 422, may provide arrow 420 with greater resistance to wind drift subsequent to being launched from a bow than an arrow having a shaft with a relatively larger diameter (e.g., a diameter substantially equivalent to the diameter of second shaft portion 424) over a greater portion of the shaft than arrow shaft 421. In at least one example, smaller diameter portions of arrow shaft 421, such as, for example, first shaft portion 422, may decrease the detrimental effects of wind resistance or cross winds that might affect the flight of arrow 420. Further, the smaller diameter portions of arrow shaft 421 may increase the overall durability and decrease the overall weight of arrow 420 when compared with an arrow having a shaft with a relatively larger diameter over a greater portion of the shaft than arrow shaft 421.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of" In addition, for ease of use, the words "including" and "having," as used in the specification and claims, are interchangeable with and have the same meaning as the word "comprising."

What is claimed is:

1. An apparatus, comprising:

an arrow shaft having a nock end and a point end, the arrow shaft comprising:

a first shaft portion comprising a lengthwise segment of the arrow shaft terminating at the nock end of the arrow shaft, the first shaft portion having an outer diameter; and a second shaft portion comprising a lengthwise segment of the arrow shaft, the second shaft portion having an outer diameter;

a first transition portion located between the first shaft portion and the second shaft portion, the transition portion being located at approximately a middle position on the arrow shaft;

wherein the outer diameter of the second shaft portion is larger than the outer diameter of the first shaft portion;

at least one of a nock mounted at the nock end and an arrow point mounted at the point end.

2. The apparatus of claim 1, wherein the first shaft portion is integrally formed with the second shaft portion.

3. The apparatus of claim 1, wherein the second shaft portion comprises a lengthwise segment of the arrow shaft terminating at the point end of the arrow shaft.

4. The apparatus of claim 1, wherein the second shaft portion is located between the point end of the arrow shaft and the first shaft portion.

5. The apparatus of claim 1, wherein the arrow shaft further comprises:

a third shaft portion comprising a lengthwise segment of the arrow shaft located between the point end of the arrow shaft and the second shaft portion, the third shaft portion having an outer diameter;

wherein the outer diameter of the third shaft portion is smaller than the outer diameter of the second shaft portion.

6. The apparatus of claim 1, wherein the arrow shaft further comprises:

a third shaft portion comprising a lengthwise segment of the arrow shaft located between the point end of the arrow shaft and the second shaft portion, the third shaft portion having an outer diameter;

wherein the outer diameter of the third shaft portion is larger than the outer diameter of the second shaft portion.

7. The apparatus of claim 1, wherein first transition portion comprises:

a first transition end adjacent to the first shaft portion;

a second transition end adjacent to the second shaft portion;

wherein an outer diameter of the second transition end is larger than an outer diameter of the first transition end.

8. The apparatus of claim 7, wherein the first transition portion is integrally formed with at least one of the first shaft portion and the second shaft portion.

9. The apparatus of claim 7, wherein the first transition portion comprises a first coupling portion structured to extend into a cavity defined in the first shaft portion.

10. The apparatus of claim 9, wherein the first transition portion further comprises a second coupling portion extending into a cavity defined in the second shaft portion.

11. The apparatus of claim 7, wherein an outer surface of the first transition portion is tapered between the second transition end and the first transition end.

12. The apparatus of claim 1, wherein the outer diameter of the first shaft portion is substantially constant along the length of the first shaft portion.

13. The apparatus of claim 1, wherein the outer diameter of the second shaft portion is substantially constant along the length of the second shaft portion.

14. The apparatus of claim 1, wherein the second shaft portion comprises approximately 50% or less of the axial length of the arrow shaft.

15. The apparatus of claim 1, wherein the first shaft portion and the second shaft portion each have a continuous, smooth outer circumference.

16. The apparatus of claim 1, wherein the nock end is a proximal end of the arrow shaft.

17. The apparatus of claim 1, wherein the point end is a distal end of the arrow shaft.

18. An arrow, comprising:

an arrow shaft, the arrow shaft comprising:

a nock end;

a point end;

a first shaft portion comprising a lengthwise segment of the arrow shaft terminating at the nock end of the arrow shaft, the first shaft portion having an outer diameter; and a second shaft portion comprising a lengthwise segment of the arrow shaft, the second shaft portion having an outer diameter;

a transition portion located between the first shaft portion and the second shaft portion, the transition portion being located at a middle position on the arrow shaft;

a nock attached at the nock end of the arrow shaft;

a point attached at the point end of the arrow shaft;

wherein the outer diameter of the second shaft portion is larger than the outer diameter of the first shaft portion.

19. The arrow of claim 18, wherein the first shaft portion is integrally formed with the second shaft portion.

20. The arrow of claim 18, wherein the second shaft portion comprises a lengthwise segment of the arrow shaft terminating at the point end of the arrow shaft.

21. The arrow of claim 18, wherein the second shaft portion is located between the point end of the arrow shaft and the first shaft portion.

22. The arrow of claim 18, wherein the arrow shaft further comprises:

a third shaft portion comprising a lengthwise segment of the arrow shaft located between the point end of the arrow shaft and the second shaft portion, the third shaft portion having an outer diameter;

wherein the outer diameter of the third shaft portion is smaller than the outer diameter of the second shaft portion.

23. The arrow of claim 18, wherein the arrow shaft further comprises:

a third shaft portion comprising a lengthwise segment of the arrow shaft located between the point end of the arrow shaft and the second shaft portion, the third shaft portion having an outer diameter;

wherein the outer diameter of the third shaft portion is larger than the outer diameter of the second shaft portion.

24. The arrow of claim 18, wherein the first transition portion comprises:

a first transition end adjacent to the first shaft portion;

a second transition end adjacent to the second shaft portion;

wherein an outer diameter of the second transition end is larger than an outer diameter of the first transition end.

25. The arrow of claim 24, wherein the first transition portion is integrally formed with at least one of the first shaft portion and the second shaft portion.

26. The arrow of claim 24, wherein the first transition portion comprises a first coupling portion structured to extend into a cavity defined in the first shaft portion.

27. The arrow of claim 26, wherein the first transition portion further comprises a second coupling portion extending into a cavity defined in the second shaft portion.

28. The arrow of claim 18, wherein the second shaft portion comprises approximately 50% or less of the axial length of the arrow shaft.

29. An apparatus, comprising:

an arrow shaft having a nock end and a point end, the arrow shaft comprising:

a first shaft portion comprising a lengthwise segment of the arrow shaft terminating at the nock end of the arrow shaft, the first shaft portion having an outer diameter; and a second shaft portion comprising a lengthwise segment of the arrow shaft, the second shaft portion having an outer diameter;

a third shaft portion comprising a lengthwise segment of the arrow shaft located between the point end of the arrow shaft and the second shaft portion, the third shaft portion having an outer diameter;

wherein the outer diameter of the second shaft portion is larger than the outer diameter of the first shaft portion, and the outer diameter of the third shaft portion is larger than the outer diameter of the second shaft portion.

30. The apparatus of claim 29, wherein the first shaft portion is integrally formed with the second shaft portion.

31. The apparatus of claim 29, wherein the second shaft portion is located between the point end of the arrow shaft and the first shaft portion.

32. An archery arrow, comprising:

a nock;

an arrow point;

an arrow shaft comprising:

a nock end having the nock mounted thereon;

a point end having the arrow point mounted thereon;

a first shaft portion terminating at the nock end of the arrow shaft and having an first outer diameter;

a second shaft portion having a second outer diameter that is greater than the first outer diameter;

a third shaft portion located between the point end of the arrow shaft and the second shaft portion, the third shaft portion having a third outer diameter that is greater than the second outer diameter.

33. The archery arrow of claim 32, further comprising a first transition portion located between the first shaft portion and the second shaft portion, and a second transition portion located between the second shaft portion and the third shaft portion.

34. The archery arrow of claim 32, wherein each of the first, second and third shaft portions has a constant outer diameter along its length.

35. An apparatus, comprising:

an arrow shaft having a nock end and a point end, the arrow shaft comprising:

a first shaft portion comprising a lengthwise segment of the arrow shaft terminating at the nock end of the arrow shaft, the first shaft portion having an outer diameter; and a second shaft portion comprising a lengthwise segment of the arrow shaft, the second shaft portion having an outer diameter;

a first transition portion located between the first shaft portion and the second shaft portion, the transition portion being located at approximately a middle position on the arrow shaft;

a third shaft portion comprising a lengthwise segment of the arrow shaft located between the point end of the arrow shaft and the second shaft portion, the third shaft portion having an outer diameter;

wherein the outer diameter of the second shaft portion is larger than the outer diameter of the first shaft portion, and the outer diameter of the third shaft portion is smaller than the outer diameter of the second shaft portion.

36. An apparatus, comprising:

an arrow shaft having a nock end and a point end, the arrow shaft comprising:

a first shaft portion comprising a lengthwise segment of the arrow shaft terminating at the nock end of the arrow shaft, the first shaft portion having an outer diameter; and a second shaft portion comprising a lengthwise segment of the arrow shaft, the second shaft portion having an outer diameter;

a first transition portion located between the first shaft portion and the second shaft portion, the transition portion being located at approximately a middle position on the arrow shaft;

wherein the outer diameter of the second shaft portion is larger than the outer diameter of the first shaft portion;

wherein the first transition portion comprises a first coupling portion structured to extend into a cavity defined in the first shaft portion.

37. The apparatus of claim 36, wherein the first transition portion further comprises a second coupling portion extending into a cavity defined in the second shaft portion.

38. An apparatus, comprising:

an arrow shaft having a nock end and a point end, the arrow shaft comprising:

a first shaft portion comprising a lengthwise segment of the arrow shaft terminating at the nock end of the arrow shaft, the first shaft portion having an outer diameter; and a second shaft portion comprising a lengthwise segment of the arrow shaft, the second shaft portion having an outer diameter;

a first transition portion located between the first shaft portion and the second shaft portion;

wherein the outer diameter of the second shaft portion is larger than the outer diameter of the first shaft portion;

at least one of a nock mounted at the nock end and an arrow point mounted at the point end;

fletching mounted to the arrow shaft, the first transition portion being located between the fletching and the point end.

39. The apparatus of claim 38, wherein the first transition portion is located between the fletching and the second shaft portion.

40. The apparatus of claim 38, wherein the fletching includes at least one vane or feather.

* * * * *